US005318370A

United States Patent [19]

Nehowig

[11] Patent Number: 5,318,370

[45] Date of Patent: Jun. 7, 1994

[54] CARTRIDGE WITH DATA MEMORY SYSTEM AND METHOD REGARDING SAME

[75] Inventor: Kelly R. Nehowig, Maple Grove, Minn.

[73] Assignee: Varitronic Systems, Inc., Minneapolis, Minn.

[21] Appl. No.: 977,809

[22] Filed: Nov. 17, 1992

[51] Int. Cl.[5] ..... B41J 29/00

[52] U.S. Cl. ..... 400/613; 400/207; 400/692

[58] Field of Search ..... 400/207 E, 208, 613, 400/692, 703, 704

[56] References Cited

U.S. PATENT DOCUMENTS

| | | | |
|---|---|---|---|
| D. 283,628 | 4/1986 | Hagiwara | D18/13 |
| 1,090,128 | 3/1914 | Avers | 400/208 |
| 3,545,004 | 12/1970 | Alden | 400/613 |
| 3,604,549 | 9/1971 | Caudill | 400/225 |
| 3,632,052 | 1/1972 | Read | 400/208 |
| 3,643,779 | 2/1972 | Anderson et al. | 400/208 |
| 3,804,227 | 4/1974 | Cappotto et al. | 400/208 |
| 3,814,231 | 6/1974 | Cappotto | 400/208 |
| 3,894,507 | 7/1975 | Koechlin | 400/208 |
| 3,994,383 | 11/1976 | Best | 400/208 |
| 4,000,804 | 1/1977 | Zaltieri | 400/225 |
| 4,140,407 | 2/1979 | Porterfield et al. | 400/208 |
| 4,145,146 | 3/1979 | Ohkawara et al. | 400/614 |
| 4,210,403 | 7/1980 | Mazouet et al. | 400/636 |
| 4,239,399 | 12/1980 | Johnstun | 400/128 |
| 4,402,619 | 9/1983 | Paque et al. | 400/36 |
| 4,407,593 | 10/1983 | Haftmann | 400/208 |
| 4,413,919 | 11/1983 | Applegate et al. | 400/208 |
| 4,419,175 | 12/1983 | Bradshaw et al. | 156/554 |
| 4,468,139 | 8/1984 | Hattori | 400/120 |
| 4,475,829 | 10/1984 | Goff, Jr. et al. | 400/232 |
| 4,496,955 | 1/1985 | Maeyama et al. | 346/76 PH |
| 4,557,617 | 12/1985 | Richardson et al. | 400/208 |
| 4,636,097 | 1/1987 | Goubeaux | 400/197 |
| 4,663,637 | 5/1987 | Saitou | 400/120 |
| 4,673,304 | 6/1987 | Liu et al. | 400/208 |
| 4,678,353 | 7/1987 | Richardson et al. | 400/248 |
| 4,679,953 | 7/1987 | Sone et al. | 400/625 |
| 4,685,818 | 8/1987 | Kazarian et al. | 400/249 |
| 4,700,791 | 10/1987 | Iwasaki et al. | 400/708 |
| 4,710,044 | 12/1987 | Ackermann | 400/208 |
| 4,741,634 | 5/1988 | Nozaki et al. | 400/175 |
| 4,747,716 | 5/1988 | van der Eikel | 400/249 |
| 4,765,765 | 8/1988 | Futakata | 400/614 |
| 4,797,018 | 1/1989 | Hofmann et al. | 400/249 |
| 4,872,027 | 10/1989 | Buskirk et al. | 400/175 |

(List continued on next page.)

FOREIGN PATENT DOCUMENTS

| | | | |
|---|---|---|---|
| 0105136A2 | 4/1984 | European Pat. Off. | 400/208 |
| 2157919 | 6/1973 | Fed. Rep. of Germany | 400/208 |
| 57-74181 | 5/1982 | Japan | 400/207 |
| 58-55277 | 4/1983 | Japan | 400/208 |
| 60-58887 | 4/1985 | Japan | 400/249 |
| 60-125685 | 7/1985 | Japan | 400/208 |
| 60-210489 | 10/1985 | Japan | 400/208 |

(List continued on next page.)

OTHER PUBLICATIONS

Dallas Semiconductor, DS1992 Touch Memory, p. 104.

D. P. Darwin, "Ribbon Drive," *IBM Technical Disclosure Bulletin,* vol. 19, No. 4, Sep. 1976.

J. A. Craft, "Low Cost Cartridge Code Detector," *IBM Technical Disclosure Bulletin,* vol. 25, No. 4, Sep. 1982.

*Primary Examiner*—David A. Wiecking

*Assistant Examiner*—Steven S. Kelley

*Attorney, Agent, or Firm*—Merchant, Gould, Smith, Edell, Welter & Schmidt

[57] ABSTRACT

A thermal printing machine is provided with a releasably attachable tape cassette which holds the tape on which an image is placed. The cassette includes a memory circuit component which includes at least 2 separate memory areas. The first area contains a first value which is read by the printing machine; the second area contains a second value which is placed on the cassette as a result of the first value having an algorithm applied to it. When the cassette is installed in the machine, the machine applies the algorithm to the first value and checks this against the second value. This process is followed in order to see it the cassette contains a compatible tape for that machine.

7 Claims, 4 Drawing Sheets

U.S. PATENT DOCUMENTS

| | | | |
|---|---|---|---|
| 4,902,146 | 2/1990 | Ishikawa | 400/692 |
| 4,930,915 | 6/1990 | Kikuchi | 400/692 |
| 4,982,378 | 1/1991 | Matsushita | 400/692 |
| 5,049,898 | 9/1991 | Arthur | 400/703 |
| 5,078,523 | 1/1992 | McGourty et al. | 400/613 |
| 5,092,686 | 3/1992 | Tsukamoto | 400/692 |
| 5,224,784 | 7/1993 | Haftmann et al. | 400/703 |

FOREIGN PATENT DOCUMENTS

| | | | |
|---|---|---|---|
| 60-240486 | 11/1985 | Japan | 400/703 |
| 61-16876 | 1/1986 | Japan | 400/208 |
| 61-68276 | 4/1986 | Japan | 400/207 |
| 61-162375(A) | 7/1986 | Japan | 400/208 |
| 61-229586 | 10/1986 | Japan | 400/208 |
| 800638 | 8/1958 | United Kingdom | 400/208 |
| 1455915 | 11/1976 | United Kingdom | 400/208 |

CARTRIDGE WITH DATA MEMORY SYSTEM AND METHOD REGARDING SAME

FIELD OF THE INVENTION

This invention pertains generally to printing or typing equipment involving the use of a thermal printing process or thermal transfer process to transfer a dry film impression onto an image carrying tape. More specifically, this invention relates to a cassette for use in a printing machine, the cassette carrying a memory circuit component which stores information for use by the printing machine to determine whether the cassette is compatible with the printing machine. This invention further relates to a printing apparatus incorporating such a cassette. This invention further relates to a method of enabling a tape cassette to operate with a printing machine.

DESCRIPTION OF PRIOR ART

In the field of commercial art, there is a significant need for simple means for transferring prefabricated letters or characters to a "paste-up" sheet for later photographing and printing. The earliest technology involving letter transfer was that of dry rub-on transfer sheets which had a series of characters preprinted thereon. These materials, however, are limited by the number of characters available on the sheet and must be very carefully aligned to produce acceptable images. Machines were later developed which printed such letters on a continuous adhesive tape. The first such machines employed print disks having raised characters. Such machines used impact printing to transfer pigment to a carrier tape. Some machines were keyboard driven while others were manual "spin and print" machines. See, for example, U.S. Pat. Nos. 3,912,064; 4,243,333; 4,462,708 and 4,579,056.

The impact printing machines mentioned above had many advantages over the rub-on letters, but still suffered from certain limitations. Specifically, these machines were necessarily complicated, heavy and relatively slow since the printing effect was accomplished by using physical force against the type face with the print media and pigment ribbon in between. Such machines were also restricted to pigment transfer of some form. In addition, an expensive type disk had to be molded for every point size, type style and language, leading to enormous costs in creating a suitable library. Certain foreign languages which are written either right to left or vertically, would require very specialized type disks. Speed was further limited because the type disks had to physically move to a new location to print each successive character. Finally, the resulting output was generally not considered smear proof and would have to be further coated if used in areas where frequent contact with the print surface was anticipated.

Thermal transfer printing, such as that known in inexpensive portable typewriters (for example Canon Typestar 5 TM, etc.), employed a new technology which used a heat generating print head to melt a wax-pigment from a carrier ribbon to a receiving tape. By using digital technology, characters could be formed of a sequence of pixels and print disks were not required. A related technology is direct thermal printing where an image is created on a thermally sensitive receiving paper directly by the head without the use of an intermediate carrier ribbon.

Thermal transfer has been applied in commercial art printing machines. Such a machine is marketed under the registered trademark Merlin Express® by Varitronics, Inc., assignee of the present invention. The Merlin Express® is the subject matter of commonly assigned U.S. Pat. No. 4,815,871. Likewise, the Merlin Express® is the subject matter of a design patent issued Apr. 17, 1990 as patent D307,296. A font module for use in the Merlin Express® is the subject matter of U.S. patent application Ser. No. 119,810 filed Nov. 12, 1987, now abandoned.

The Merlin Express® employs a tape cassette (referred to as a cartridge in the aforementioned patent applications) which carries both an image receiving tape and an image carrying ribbon. The image receiving tape is carried on a spool housed in the cassette. The image carrying ribbon is likewise carried on a spool housed in the cassette. The image carrying tape is guided from its spool to a free end. A take-up spool is provided within the cassette for winding up the image carrying ribbon as it is utilized. The tape and ribbon are disposed so that in at least a predetermined location they are in face-to-face alignment. At the predetermined location, the cassette includes an opening which receives a transfer head and a platen when the cassette is mounted on the printing machine. The opposing tape and ribbon are disposed between the platen and the head. A gear mechanism within the head control apparatus urges the platen and head into close abutting relation with the tape and ribbon captured between them. Circuitry in the printing machine drives the platen to advance the tape and ribbon. When a desired character is inputted by an operator, the electronics of the machine energizes pixels on the thermal transfer head as the tape and ribbon advance past the head. When a command to print a letter is given a step motor actuates the platen. The head pixels are variously energized to imprint the letter on the tape.

In a printing machine such as the Merlin Express®, the machine is limited in that only a particular width of tape can be used. Also, the amount of thermal energy which is needed to effect the transfer at the pixels preferably varies from one type of tape and pigment to another. For example, it may be desirable to transfer a white pigment onto a clear or black tape. Alternatively, it may be desirable to transfer a black pigment onto either a clear or white tape. Due to variations in types of pigments and tapes, the optimum amount of energy to effect this transfer will vary with the types of tapes and ribbons being used. Likewise, it is desirable for the machine to be able to sense numerous characteristics related to a cassette (size, density, type, etc.) by mere insertion of the cassette into the machine.

To accomplish this, cassettes can be provided with electrical circuit elements which are disposed to electrically engage exposed electrical connectors carried by the printing machine. This is described in U.S. Pat. No. 5,078,523, issued Jan. 7, 1992, to McGourty et al. and assigned to Varitronics, Inc., the assignee of the present application. U.S. Pat. No. 5,078,523 is incorporated herein by reference. In the McGourty '523 arrangement, the circuit elements are selected to cooperate with the circuitry of the printing machine to indicate desired characteristics of the cassette.

It would be desirable for a cassette to be provided with electrical circuit elements that, in cooperation with the printing machine, determine whether the cassette is compatible with the printer, and thereby whether the printer should be enabled. Use of an incompatible cassette may cause damage to the printing machine, or may cause the printing machine to create unsatisfactory images, with the user having no means of determining whether the problem lies in the printing machine itself, or in the cartridge, or in the incompatibility of the two.

SUMMARY OF THE INVENTION

According to a preferred embodiment of the present invention, a printing apparatus is provided including a printing machine having a thermal printing head energized in response to signals from a printing machine circuitry. A tape cassette releasably attaches to the printing machine and has a tape for receiving an image generated by the energizing of the thermal printing head. A memory circuit component is carried on the tape cassette and includes at least a first and a second memory address. The first memory address contains a first value, and the second memory address contains a second value derived from applying a predetermined algorithm to the first value. The machine circuitry includes contacts for connecting the memory circuit component to the printing machine circuitry. The machine circuitry is adapted to read the first value and apply the algorithm to the first value to generate a test value. It then compares the test value to the second value. If they are the same, the printing machine is enabled.

According to a preferred method of the present invention, a tape cassette is enabled under appropriate circumstances. More specifically, the method enables a tape cassette to operate with a printing machine wherein the printing machine includes a thermal printing head energized in response to signals from machine circuitry. The machine circuitry reads values from a first address and from a second address of a memory circuit component located on the tape cassette. Each memory circuit component is selected from one of a plurality of components, each having a unique first value at the first address. The component is carried on a tape cassette releasably attached to the printing machine. The machine circuitry applies an algorithm to the first value to generate a test value. The circuitry compares the test value to a value read at the second address. The method comprises the following steps: reading a first value; applying an algorithm to the first value to generate a second value; writing the second value into the second address.

This invention further relates to a preferred tape cassette for a printing machine having a thermal head energized in response to signals from machine circuitry. The machine circuitry includes contact means exposed in a predetermined location and electrically connected to the machine circuitry. The machine circuitry includes means for reading at least a first and a second value contained in a first and second address of a memory circuit component in contact with the contact means. The machine circuitry further includes means for applying an algorithm to the first value to generate a test value and to compare the test value to the second value. The cassette includes means for releasably attaching the tape cassette to the machine in a predetermined position. The memory circuit component carried on the cassette is disposed to be in electrical contact with the contact means when the cassette is in the predetermined position. The memory circuit component includes at least the first address containing the first value and the second address containing the second value with the second value being derived by applying the algorithm to the first value.

DESCRIPTION OF THE PREFERRED EMBODIMENTS

1. General Description

Referring to the several figures in which like elements are identically numbered throughout, preferred embodiments of the present invention will now be described.

Figure 1:
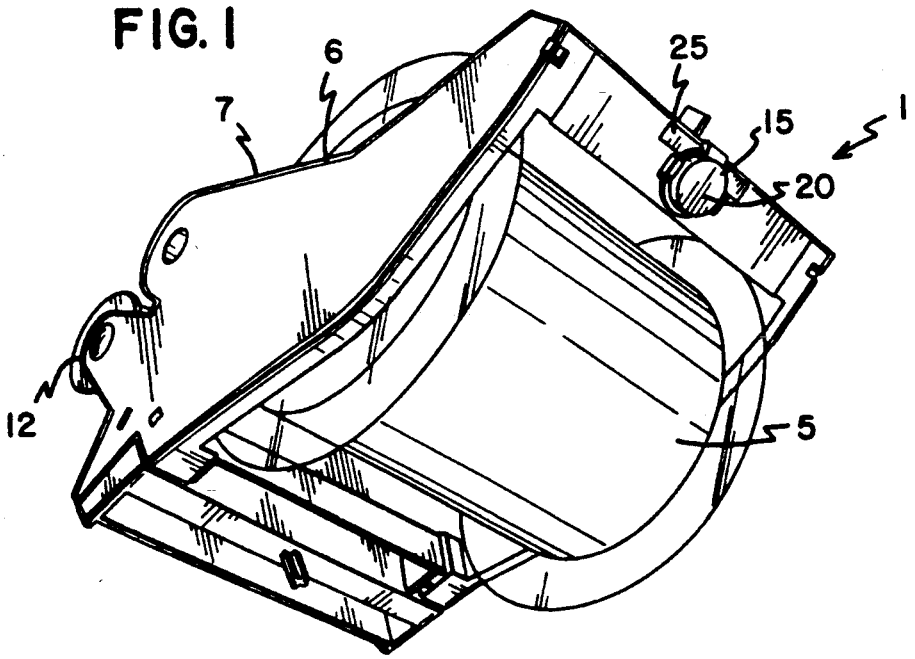
FIG. 1 is a prospective view of a tape cassette incorporating the present invention.

With reference to FIG. 1, a tape cartridge or cassette 1 is illustrated. The tape cartridge 1 illustrated in FIG. 1 is illustrative or exemplary of a tape cartridge. Tape cartridges which are useable in conjunction with the present invention may come in a number of forms or arrangements, such as that described in U.S. Pat. No. 5,078,523, incorporated herein by reference.

Generally, a tape cartridge or cassette 1 includes a paper supply roll or tape 5 supported by structure 6 in a frame 7. The paper supply roll 5 is supported such that it can be rotated about its longitudinal axis to dispense paper therefrom. The frame 7 allows for paper to be dispensed from the paper roll 5 through an opening or slot (not shown) defined in the frame 7. For use in a thermal printing machine, a tape cartridge 1 typically also includes structure 112 for supporting an image carrying ribbon supply. The image carrying tape supply dispenses image carrying tape as it is unwound from its spool. The free end of the ribbon is guided by the frame to a take-up spool. The tape and ribbon are disposed so that in at least one predetermined location, they are in face-to-face alignment. At a predetermined location, the tape cassette. includes an opening which receives a transfer head and a platen when the cassette is mounted on a printing machine.

In the embodiment illustrated in FIG. 1, frame 7 carries a memory circuit component 15, which will be described in greater detail below. At this point, it is adequate to understand that memory circuit component 15 includes a first contact surface 20. Additionally, memory circuit component 15 has a second contact surface 22 which, in the embodiment illustrated in FIG. 1, is generally parallel to and spaced from first contact surface 20 and is not visible in FIG. 1. In the embodiment of FIG. 1, a contact surface extension 25 is in electrical contact with second contact surface 22 and extends laterally outward from the memory circuit component to provide access to the contact surface extension 25. Contact surface extension 25 is preferably of some electrically conductive material, such as copper.

Figure 2:
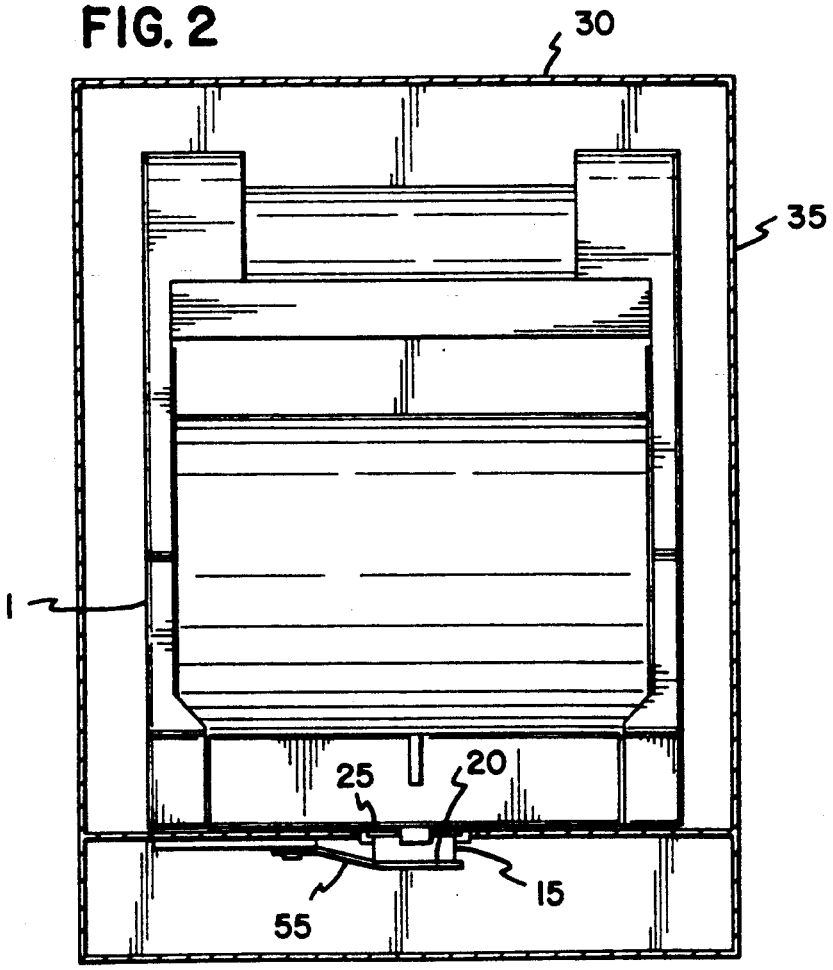
FIG. 2 is a front sectional view of the cartridge illustrated in FIG. 1 inserted into a printing machine.

FIG. 2 illustrates tape cassette 1 inserted in a printing machine. The printing machine is depicted relatively schematically. The exact manner in which the tape cassette engages the printing machine is of little concern to the present invention, as long as they are compatible, and structure is provided for electrical connection between the two.

Generally, a printing machine of the type relevant to this application typically includes structure 35 for receiving a tape cartridge or cassette 1. The printing machine 30 further typically would include a driving mechanism (not shown) to advance the tape and/or the ribbon in the tape cartridge 1. A thermal print head (not shown) is provided in the printing machine and is arranged to cooperate with the ribbon and tape of the cartridge 1 such that the thermal print head can print characters or symbols onto the tape 5. This is described in greater detail in U.S. Pat. No. 5,078,523 which has been incorporated herein by reference.

More specifically, a gear mechanism within the printing machine urges a platen into close abutting relation with the tape and ribbon captured between the platen and a transfer head. Circuitry in the printing machine drives the platen to advance the tape and ribbon. When a desired character is input by an operator, the electronics of the machine energizes pixels on the thermal transfer head as the tape and ribbon advance past the head. When a command to print a letter is given, a step motor actuates the platen. The head pixels are variously energized to imprint the letter on the tape. This is described in greater detail in U.S. Pat. No. 5,078,523, which has been incorporated herein by reference.

The printing machine 30 typically includes a keyboard by which the user is able to selectively input the characters or symbols desired to be printed. Typically the machinery 30 will include a display, such as an LCD display, which shows the user what characters or symbols have been typed, so that, for instance, mistakes can be corrected prior to printing.

A printing machine 30 further includes electrical circuitry which performs a number of functions. For example, the circuitry conveys the users input and characters or symbols to the thermal print head. Further, according to the present invention, a printing machine 30 includes electrical circuitry 50 which is in contact with the memory circuit component 15 of the cartridge or cassette 1. This electrical circuitry 50 terminates in first and second contacts 55 and 56. One of these contacts 55 engages the first contact surface 20 of the memory circuit component 15. In the embodiment illustrated in FIG. 2, first contact 55 is formed of a spring leaf-like member 57. The second contact 56 engages the second contact surface 22 of the memory circuit component 15. In the embodiment illustrated, the second contact 56 of the printing machine circuitry contacts the contact surface extension 25 located on the cartridge frame 7. Thus, when cartridge 1 is inserted into the printing machine 30, the memory circuit component 15 becomes a part of the electrical circuitry 50 of the printing machine.

Figure 3:
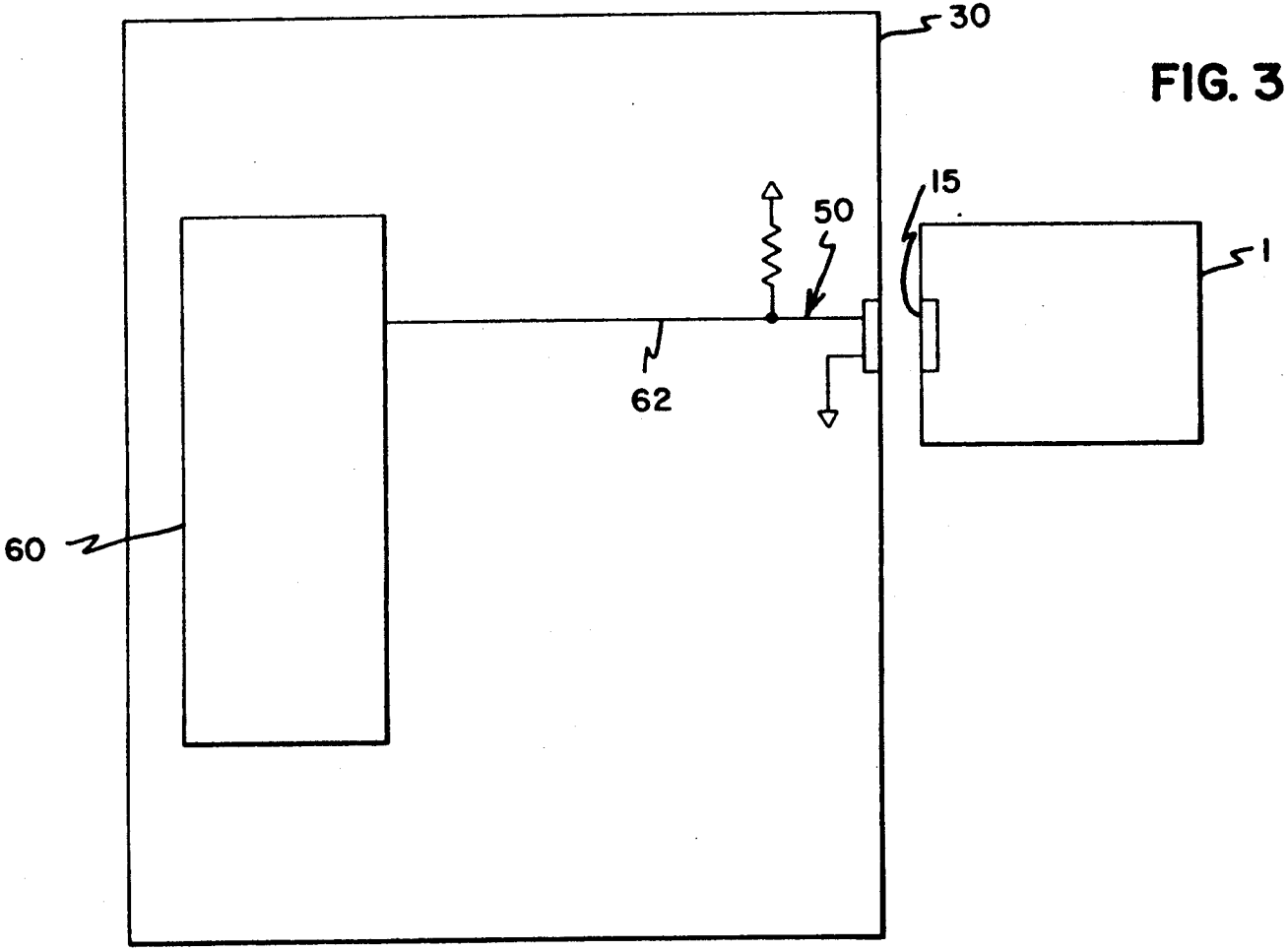
FIG. 3 is a schematic view of a printing machine and tape cassette incorporating the present invention.

As illustrated in FIG. 3, the electrical circuitry 50 of the printing machine 30 includes a microprocessor 60 linked to electrical contacts 55 and 56 through a bidirectional data line 62. Through the data line 62, the microprocessor 60 can pass information to and from the memory circuit component 15.

2. Memory Circuit Component

Figure 4:
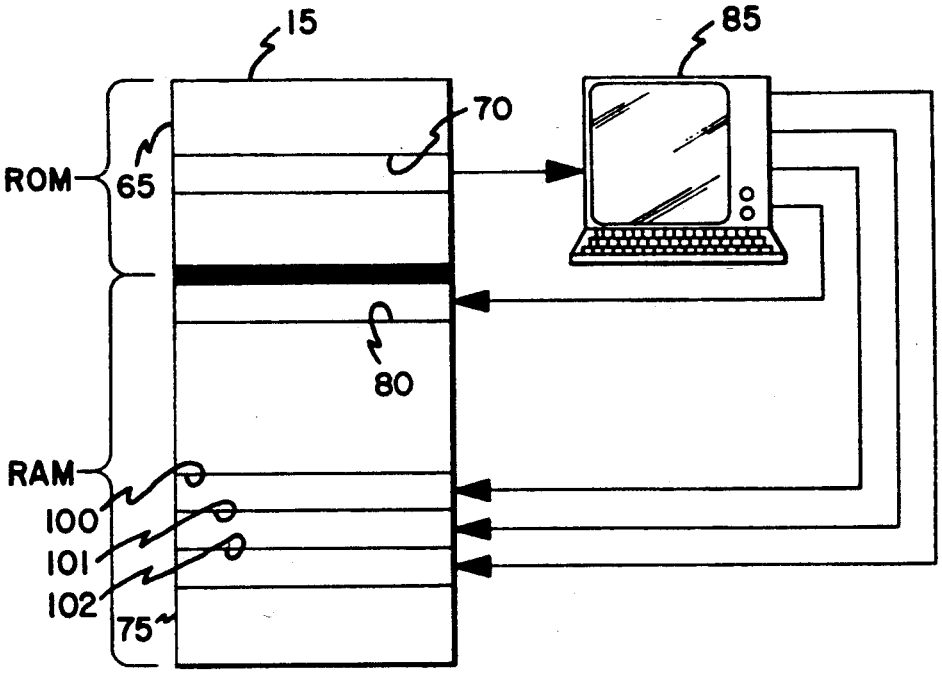
FIG. 4 is a schematic diagrammatic representation of a memory circuit component, with arrowed lines indicating flow of information between a memory circuit component and a personal computer.

The memory circuit component 15 is of the type possessing a read only memory (ROM) section, as well as a random access memory (RAM) section. An example of a memory circuit component 15 that is commercially available is the DS 1992 Touch Memory, made by Dallas Semi conductor of Dallas, Tex. The read only memory portion, illustrated in FIG. 4 at reference numeral 65, includes a plurality of addresses in which information can be stored. In one of the addresses is a serial number which is unique to each memory circuit component. In the DS 1992, this number is factor-lasered has 48-bits serial number. In FIG. 4, that address is indicated by a horizontally-extending space indicated by reference number 70. Because this address is located within the ROM section 65 of the memory circuit component 15, it is not possible to write over the information given at this first memory address 70.

The RAM portion 75 of the memory circuit component 15 similarly has a plurality of addresses for storing information. Because section 75 is random access, information can be written into and read from the addresses in the RAM section of the memory circuit component 15. One address of particular importance, as will be understood from the discussion below, is indicated schematically by the space indicated by reference number 80, which will be identified as a second memory address.

According to the present invention, during manufacturing of a tape cartridge 1, one memory circuit component 15 is selected and electronically connected to a personal computer 85. The personal computer 85 reads the serial number or first value located in first memory address 70. This serial number is unique to that particular memory circuit component. The PC 85 performs an algorithm on the serial number which modifies the serial number to create a second value which it then writes to second memory address 80 in the memory circuit component 15. Thus, in the manufacturing process, the serial number or first value located in the first memory address is converted into another number and placed in the second memory address 80, and that conversion is made by applying a particular algorithm to the information located in the first memory address 70.

In use, when the tape cassette 1 is placed in the printing machine, with the memory circuit component 15 in electrical connection with the printing machine 30, the microprocessor 60 in the printing machine 30 reads the serial number or first value located in first address 70. After reading the serial number, the microprocessor 60 in the printing machine 30 performs the same algorithm as was performed by the PC 85 during the manufacturing process. Thus, the printing machine microprocessor 60 arrives at a test value, which is the first value modified by the algorithm. The microprocessor then reads the information or number in the second memory address 80 and compares that second value 80 with the test value generated by the printing machine microprocessor 60. If the test value matches the value located in second memory address 80, then the printing machine is enabled, having been satisfied that the cartridge is compatible with the printing machine. If the test value generated by the printing machine microprocessor 60 does not match the number located in second memory address 80, then the printing machine is precluded from operating.

Figure 6:
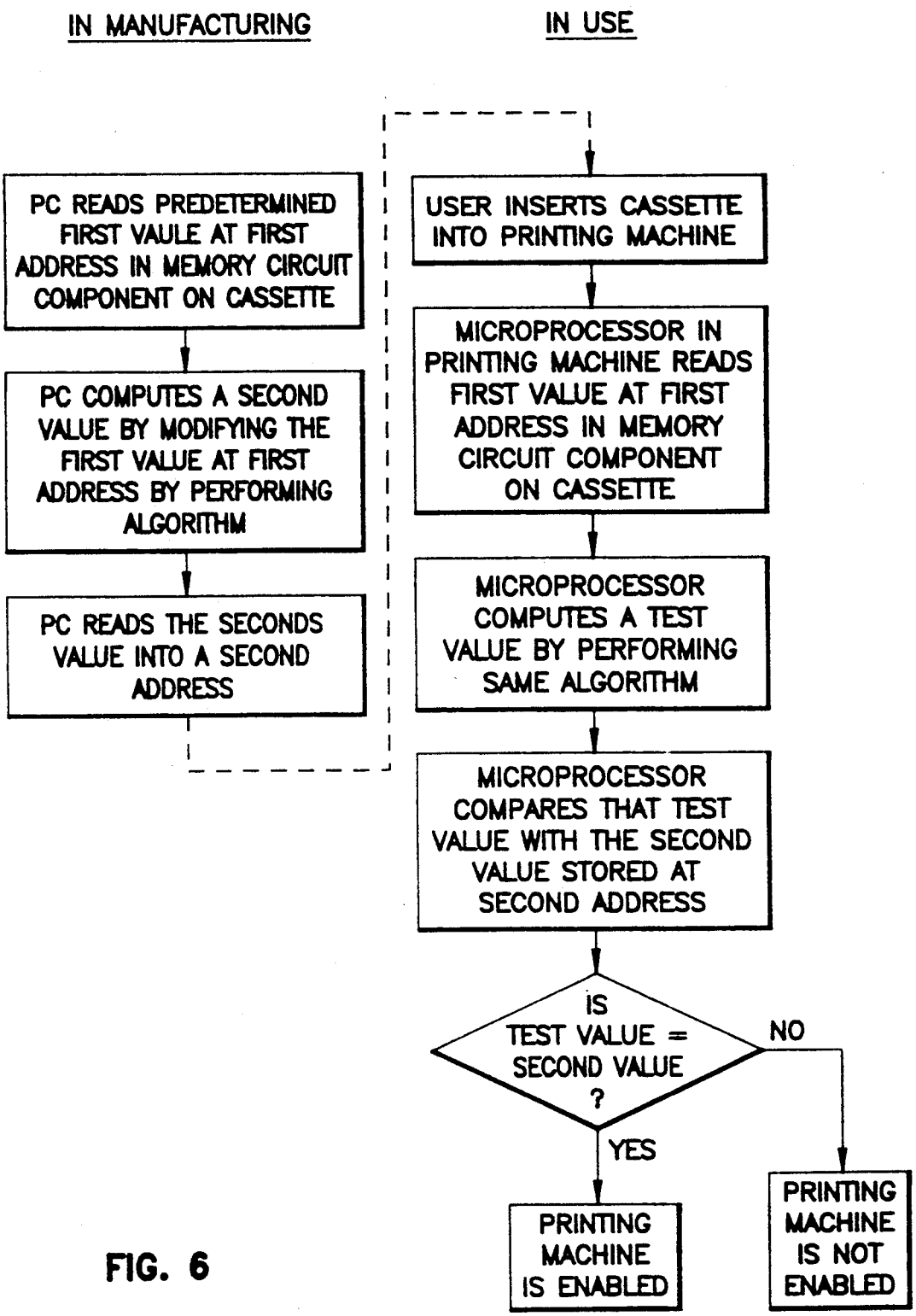
FIG. 6 is a flow chart illustrating flow of information to and from a memory circuit component.

FIG. 6 illustrates, in flowchart form, the use of a memory circuit component to enable a printing machine as described above. FIG. 6 is generally divided into two columns. The steps in the left hand column take place during manufacturing of a tape cassette. The steps in the right hand column occur during use of a tape cassette.

3. Uses for Other Addresses in RAM

Figure 5:
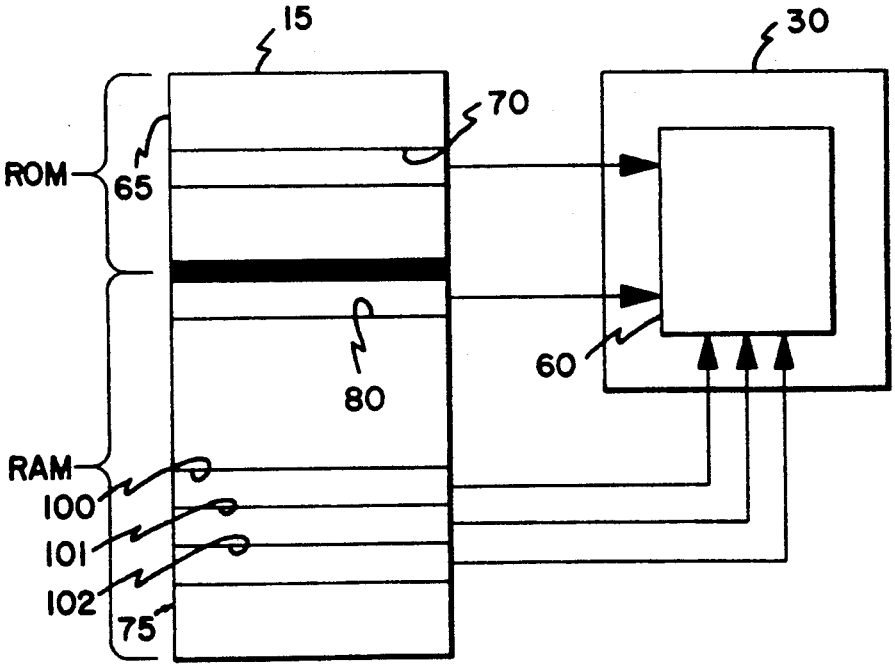
FIG. 5 is a schematic diagram of a memory circuit component with arrowed lines indicating flow of information to a printing machine.

As illustrated in FIGS. 4 and 5, the RAM section 75 of a memory circuit component 15 includes a plurality of addresses. During manufacturing, the PC 85 can be used to write into those addresses various characteristics of the cartridge onto which the memory circuit component is being placed. For example, characteristics such as size, burn time, length, color, and so forth can be inserted into various addresses within the RAM portion of the component 15. Three exemplary addresses are given by reference numbers 100, 101 and 102 in FIGS. 4 and 5. In use, the microprocessor 60 of the printing machine 30 reads from these addresses so as to "learn" the characteristics of the cartridge that has been inserted into the machine 30. The printing machine 30 can then adjust burn time, size of print, and so forth, accordingly. In general, this is described in U.S. Pat. No. 5,078,523, discussed above.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts, within the principles of the invention to the full extent indicated by the broad general meaning of the terms in which the appended claims are expressed.

What is claimed:

1. A printing apparatus comprising:

a printing machine having a thermal printing head energized in response to signals from a printing machine circuitry;

a tape cassette releasably attachable to said machine and having a tape for receiving an image generated by reason of said energizing of said thermal printing head;

a memory circuit component carried on said tape cassette and including at least a first and a second memory address, said first memory address containing a first value, said second memory address containing a second value derived from applying a predetermined algorithm to said first value;

said machine circuitry including contact means for connecting said memory circuit component to said machine circuitry;

said machine circuitry further including means for reading said first value and applying said algorithm to said first value to generate a test value and then comparing said test value to said second value.

2. An apparatus according to claim 1 wherein said memory circuit component is selected from one of a plurality of said components, said first value of said selected component unique to said selected component.

3. An apparatus according to claim 2 wherein said first address is a read only memory address and wherein said second address is a random access memory address.

4. A method for enabling a tape cassette to operate with a printing machine wherein said printing machine includes a thermal printing head energized in response to signals from a machine circuitry, said machine circuitry including means for reading a value from a first and second address of a memory circuit component comprising a selected one of a plurality of components each having a unique first value at said first address, said component carried on a tape cassette releasably attached to said printing machine and said machine circuitry further including means for applying an algorithm to said first value to generate a test value and comparing the test value to a value read at said second address, said method comprising the following steps:

reading said first value;

applying said algorithm to said first value to generate a second value;

writing said second value into said second address.

5. A tape cassette for a printing machine having a thermal head energized in response to signals from a machine circuitry and said machine circuitry including contact means exposed in a predetermined location and electrically connected to said machine circuitry, said machine circuitry including means for reading at least a first and a second value contained in a first and second address of a memory circuit component in contact with said contact means and said machine circuitry further including means for applying an algorithm to said first value to generate a test value and comparing the test value to the second value, said cassette comprising:

means for releasably attaching said tape cassette to said machine in a predetermined position;

said memory circuit component carried on said cassette and disposed to be in electrical contact with said contact means when said cassette is in said predetermined position;

said memory circuit component including at least said first address containing said firs value and said second address containing said second value with said second value derived from applying said algorithm to said first value.

6. A cassette according to claim 5 wherein said cassette memory circuit component is selected from one of a plurality of said components and where said first value is unique to said selected component.

7. A cassette according to claim 6 wherein said memory circuit component first address is a read only memory address and wherein said second address is a random access memory address.

* * * * *

UNITED STATES PATENT AND TRADEMARK OFFICE

CERTIFICATE OF CORRECTION

PATENT NO. : 5,318,370

DATED : June 7, 1994

INVENTOR(S) : Kelly R. Nehowig

It is certified that error appears in the above-identified patent and that said Letters Patent is hereby corrected as shown below:

On title page,

In the Abstract, line 13, "it" should read --if--.

Column 8, line 47, "firs" should read —first—.

Signed and Sealed this

Twenty-first Day of February, 1995

Bruce Lehman

*Attest:*

BRUCE LEHMAN

*Attesting Officer*

*Commissioner of Patents and Trademarks*